US008540292B2

(12) United States Patent
Ferguson

(10) Patent No.: US 8,540,292 B2
(45) **Date of Patent: *Sep. 24, 2013**

(54) REVERSIBLE MAGNETIC DOOR STOP/LATCH

(76) Inventor: Edward B. Ferguson, Winnetka, IL (US)

( * ) Notice: Subject to any disclaimer, the term of this patent is extended or adjusted under 35 U.S.C. 154(b) by 104 days.

This patent is subject to a terminal disclaimer.

(21) Appl. No.: 12/647,941

(22) Filed: Dec. 28, 2009

(65) Prior Publication Data

US 2010/0162523 A1 Jul. 1, 2010

Related U.S. Application Data

(60) Continuation-in-part of application No. 11/636,722, filed on Dec. 11, 2006, now Pat. No. 7,637,543, which is a division of application No. 10/620,804, filed on Jul. 2, 2003, now abandoned, which is a division of application No. 10/308,109, filed on Dec. 3, 2002, now Pat. No. 6,588,811.

(51) Int. Cl.
*E05C 17/56* (2006.01)

(52) U.S. Cl.
USPC ..... 292/251.5; 24/303

(58) Field of Classification Search
USPC ..... 292/251.5; 16/82, 85, 320; 24/303; 70/276
See application file for complete search history.

(56) References Cited

U.S. PATENT DOCUMENTS

| | | | | |
|---|---|---|---|---|
| 1,701,202 A | | 2/1929 | Dudley | |
| 2,471,635 A | | 5/1949 | Mark et al. | |
| 2,496,691 A | | 2/1950 | Berry | |
| 2,584,480 A | | 2/1952 | Manting | |
| 2,761,718 A | | 9/1956 | Tool | |
| 2,955,239 A | | 10/1960 | Rouse | |
| 3,288,511 A | * | 11/1966 | Tavano | 292/251.5 |
| 3,300,239 A | | 1/1967 | Dinkin | |
| 3,326,588 A | * | 6/1967 | Clark | 292/251.5 |
| 3,596,958 A | * | 8/1971 | Bowerman | 292/201 |
| 3,647,165 A | | 3/1972 | Whitla | |
| 3,691,688 A | | 9/1972 | Kaiserswerth | |
| 3,744,833 A | | 7/1973 | Berducone | |
| 3,790,197 A | | 2/1974 | Parker | |
| 4,364,019 A | | 12/1982 | Hutter | |
| 4,434,524 A | | 3/1984 | Gilchrist | |
| 4,505,502 A | | 3/1985 | Tomita | |
| 4,682,801 A | | 7/1987 | Cook et al. | |
| 5,485,733 A | | 1/1996 | Hoffman | |
| 5,771,533 A | | 6/1998 | Kuang-Pin | |

(Continued)

FOREIGN PATENT DOCUMENTS

| | | |
|---|---|---|
| DE | 3323993 A | 1/1985 |
| DE | 003837547 A1 | 5/1990 |

(Continued)

*Primary Examiner* — Gary Estremsky

(74) *Attorney, Agent, or Firm* — Sterne, Kessler, Goldstein & Fox P.L.L.C.

(57) ABSTRACT

A magnetic door stop/latch contains a first magnet mounted on or within a door and a second magnet mounted on or within a structure opposing the door, such as a wall, door jamb, door frame or baseboard. When the door is moving towards the opposing structure, the magnetic door stop may used to prevent the door from slamming into the opposing structure by virtue of the repulsive forces of the magnets. The magnetic door stop may be switched from repulsive configuration to an attractive configuration that holds the door in position.

15 Claims, 12 Drawing Sheets

(56) References Cited

U.S. PATENT DOCUMENTS

| | | | |
|---|---|---|---|
| 5,782,512 | A | 7/1998 | Cargnoni |
| 5,944,368 | A | 8/1999 | Hastings |
| 6,135,515 | A | 10/2000 | Roth et al. |
| 6,167,589 | B1 | 1/2001 | Luedtke |
| 6,408,484 | B1 | 6/2002 | Vandertouw |
| 6,489,871 | B1 | 12/2002 | Barton |

FOREIGN PATENT DOCUMENTS

| | | | |
|---|---|---|---|
| EP | 0068988 | | 1/1983 |
| FR | 1179194 | | 5/1959 |
| GB | 205603 | A | 12/1988 |
| JP | 54-13000 | | 1/1979 |
| JP | 3-193881 | | 8/1991 |
| JP | 404185880 | A | 7/1992 |
| JP | 6-221045 | | 8/1994 |

* cited by examiner

REVERSIBLE MAGNETIC DOOR STOP/LATCH

CROSS REFERENCE TO RELATED APPLICATIONS

This application is a continuation-in-part of U.S. application Ser. No. 11/636,722 filed Dec. 11, 2006, which is a divisional of U.S. application Ser No. 10/620,804 filed Jul. 2, 2003, now abandoned, which is a divisional of U.S. application Ser. No. 10/308,109 filed Dec. 3, 2002 that issued as U.S. Pat. No. 6,588,811 on Jul. 8, 2003, the entire disclosure of which is hereby incorporated by reference.

BACKGROUND OF THE INVENTION

1. Field of the Invention

This invention relates to magnetic door stops and latches. More particularly, this invention relates to a device that uses the attractive and repulsive characteristics of magnets or magnetized objects for purposes of (1) preventing doors and other similar closures from slamming against a wall, baseboard, door jamb or door frame, or minimizing the force of such slamming, and (2) holding doors or similar closures in a stationary open or closed position, such that the door can be moved from such stationary position by applying sufficient force to overcome the magnetic force.

2. Background Art

Magnets have been used in devices for holding doors in the closed position. For example, magnetic door latch devices have been previously developed and are commonly found in the doors of kitchen cabinets, refrigerators, freezers, media cabinets, storage containers and numerous other such closures. Magnets have also been used in connection with mechanical latches and locks, with magnetic (usually electromagnetic) force applied to move or actuate a mechanical latch or lock mechanism.

Other magnetic devices have been previously developed for holding doors open. For example, simple magnetic door catches, such as that disclosed in U.S. Pat. No. 4,505,502, are also well known. Such devices use permanent magnetic force to hold a door in the open position, but perform no other function. Magnetic door holding devices also have been previously used in connection with fire safety systems, in which fire doors are held open by magnetic contacts on both the door and a wall behind the door. In such devices, the magnetic force holding the door open is overcome by electromagnetic or other means, thus automatically allowing the fire doors to swing closed.

While the use of magnets in these applications is well known, magnetic forces are not addressed to the problem of stopping doors from slamming or banging when opened or closed violently. Therefore, there arises a need in the art for a magnetic door stop that uses the repulsive forces of the magnets to prevent a door from slamming into a wall or door frame. More specifically, there arises a need in the art for a magnetic door stop that uses both the repulsive and attractive forces of magnets, selectively at the option of the user, to either hold a door in the open position (using the attractive forces of the magnets) or prevent a door from slamming (using the repulsive forces of the magnets).

BRIEF SUMMARY OF THE INVENTION

To achieve the foregoing and other objects, and in accordance with the purposes of the present invention as embodied and broadly described herein, the present invention provides a magnetic apparatus that functions to prevent slamming of a door or other such closure or structure using the repulsive forces of a magnet. The present invention also provides such a device that can be selectively set by the user so that in one position the device secures a door or other such closure or structure in an opened or closed position (using the attractive forces of the magnets) and in another position the device acts to prevent a door or other closure or structure from slamming (using the repulsive forces of the magnets).

In accordance with one aspect of the present invention, one magnet is mounted on or within a door and one magnet is mounted on or within a structure opposing the door, such as a baseboard, wall, or doorframe. The like poles of the magnets are adjacent to one another and thus repel one another. This may be accomplished in many possible configurations, including with the magnets aligned so that they make contact with one another upon the exertion of sufficient force, or with the magnets not actually making contact with one another but rather reaching sufficient proximity for the repulsive force to act in controlling or arresting the motion of the door.

In further accordance with the present invention, one of the two magnets may be mounted in a fashion that allows the magnet to be rotated, flipped or otherwise repositioned, such that in a one position, opposite magnetic poles of two magnets are adjacent to each other, and in a second position, like magnetic poles of the magnets are adjacent to each other.

The present invention has the advantages of providing an inexpensive, simple, and easy to operate mechanism that prevents noise and damage from slamming doors, but yet can be easily overridden by application of a moderate amount of manual force. The present invention also provides a simple means of selectively holding a door open or closed, but in a manner that allows the door to be manually moved. The simplicity of the present invention can be described as "binary," in that the stop/latch has only two operational states—either the attractive state or the repulsive (non-attractive) state. All of these advantages are achieved without moving parts, or with a minimal number of moving parts, thus reducing the difficulties associated with installation, maintenance and use.

BRIEF DESCRIPTION OF THE DRAWINGS/FIGURES

The foregoing and other features and advantages of the invention will be apparent from the following, more particular description of a preferred embodiment of the invention, as illustrated in the accompanying drawings.

DETAILED DESCRIPTION OF THE INVENTION

A preferred embodiment of the present invention is now described with reference to the figures, where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention.

Figure 1:
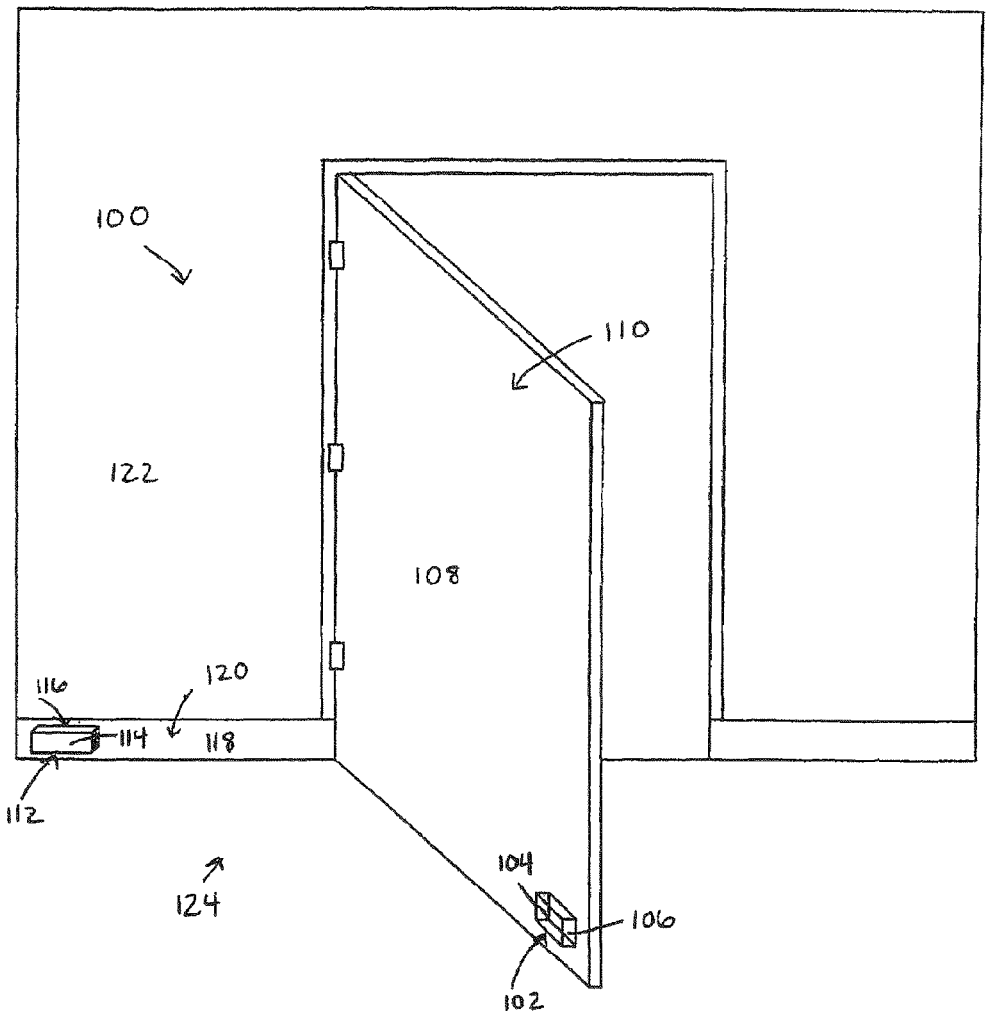
FIG. 1 shows the magnetic door stop in the repulsive configuration to prevent a door from slamming into an opposing wall and baseboard.

Referring to FIG. 1, an embodiment of magnetic door stop 100 is shown. A first magnet 102 having a "positive" end 104 and a "negative" end 106 is mounted on an outside or exterior surface 108 of door 110. For the purposes of this disclosure, the door has a height, width and depth or thickness, which defines a first side or surface, a second side or surface and a surrounding exterior edge. A second magnet 112 having a "positive" end 114 and a "negative" end 116 is mounted on an outside or exterior surface 118 of baseboard 120. Second magnet 112 may be mounted on other structures opposing door 110 such as wall 122. It should be noted that first magnet 102 may be mounted within the thickness of door 100 and that second magnet 112 may be mounted within the thickness of baseboard 120 or other structure. When door 110 is being opened and therefore moving towards wall 122, magnetic door stop 100 may be in repulsive configuration 124 to prevent door 110 from slamming into wall 122. Repulsive configuration 124 is accomplished when the like poles of first and second magnets are adjacent to one another and thus repel one another, i.e. "positive" end 104 of first magnet 102 will repel "positive" end 114 of second magnet 112 and "negative" end 106 of first magnet 102 will repel "negative" end 116 of second magnet 112. This may be accomplished in many possible configurations, including with the magnets aligned so that they make contact with one another upon the exertion of sufficient force, or with the magnets not actually making contact with one another but rather reaching sufficient proximity for the repulsive force to act in controlling or arresting the motion of the door. Repulsive configuration 124 results in preventing door 110 from slamming against wall 122.

Figure 2:
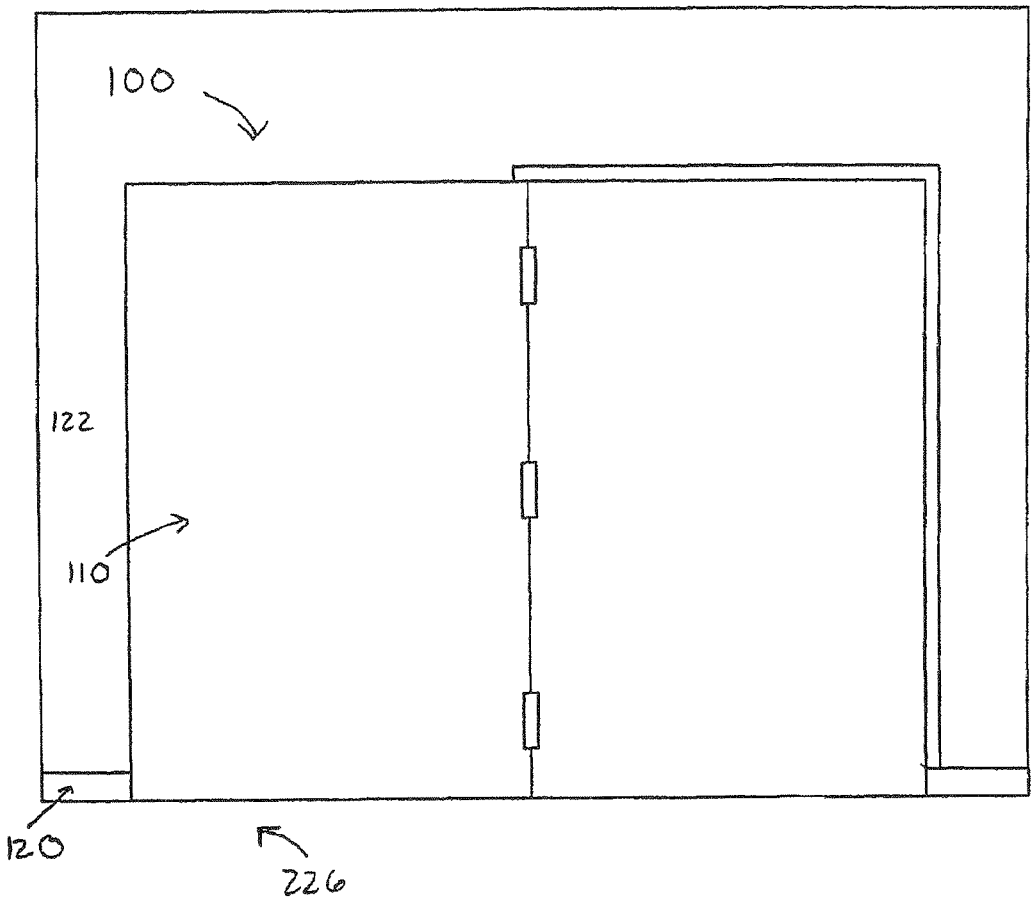
FIG. 2 shows the magnetic door stop in the attractive configuration to hold the door in an open position.

As shown in FIG. 2, magnetic door stop 100 also can secure door 110 in an opened position by utilizing attractive configuration 226. Attractive configuration 226 is accomplished when the opposite poles of first magnet 102 and second magnet 112 are adjacent to one another and thus attract one another, i.e. "positive" end 104 of first magnet 102 will attract "negative" end 116 of second magnet 112 and "negative" end 106 of first magnet 102 will attract "positive" end 114 of second magnet 112. Attractive configuration 226 results in door 110 being held in an open position.

Figure 3:
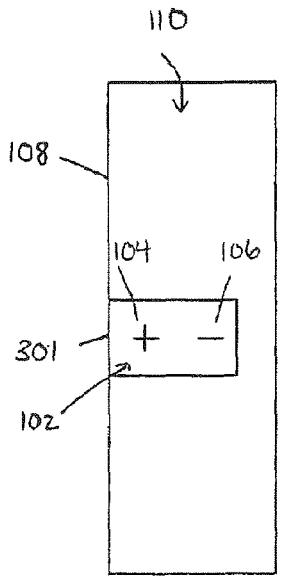
FIG. 3 is a side view of the magnetic door stop mounted within a door.
Figure 4:
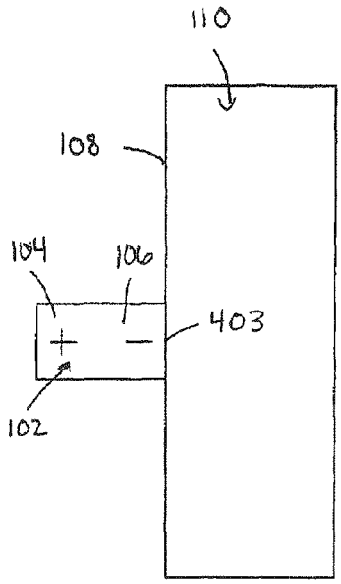
FIG. 4 is a side view of the magnetic door stop mounted on an exterior surface of a door.

As shown in FIG. 3, first magnet 102 may alternatively be located within the thickness of door 110 such that an edge 301 of first magnet 102 is flush with exterior surface 108 of door 110. Alternatively, first magnet 102 may be located on an exterior surface of door 110 such that another edge 403 of first magnet 102 is flush with exterior surface 108 of door 110 as shown in FIG. 4. The location of first magnet 102 and second magnet 112 is not limited to the bottom left corner of door 110 and the corresponding opposing position on baseboard 120, as shown in FIG. 1. Instead, first magnet 102 may be located anywhere on exterior surface 108 of door 110 or within the door's thickness. Likewise, second magnet 112 may be located in the corresponding opposing position on or within the thickness of baseboard 120 or wall 122 such that when door 110 swings open, first magnet 102 and second magnet 112 are adjacent. Also, while magnet 102 is mounted on or within door 110 horizontally, it should be realized by those skilled in the art that magnet 102 may be mounted vertically relative to the door.

Figure 5:
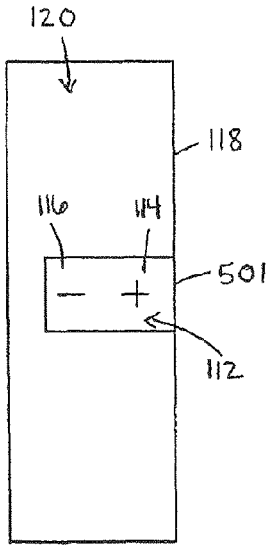
FIG. 5 is a side view of the magnetic door stop mounted within a baseboard.
Figure 6:
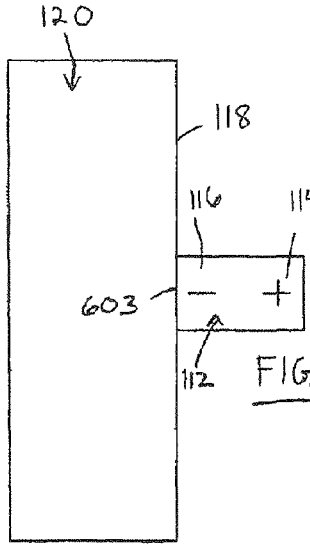
FIG. 6 is a side view of the magnetic door stop mounted on an exterior surface of a baseboard.

As shown in FIG. 5, second magnet 112 may be located within the thickness of baseboard 120 such that an edge 501 of second magnet 112 is flush with exterior surface 118 of baseboard 120. Alternatively, second magnet 112 may be located on an exterior surface of baseboard 120 such that an edge 603 of second magnet 112 is flush with outside surface 118 of baseboard 120 as shown in FIG. 6. Like first magnet 102, second magnet 112 may be mounted on or within baseboard 120 either vertically or horizontally. Further, while first magnet 102 is shown mounted on a door and second magnet 112 is shown located on a baseboard, it should be realized by those skilled in the art that first magnet 102 may be mounted on baseboard 120 and second magnet 112 may be mounted on door 110.

Figure 7:
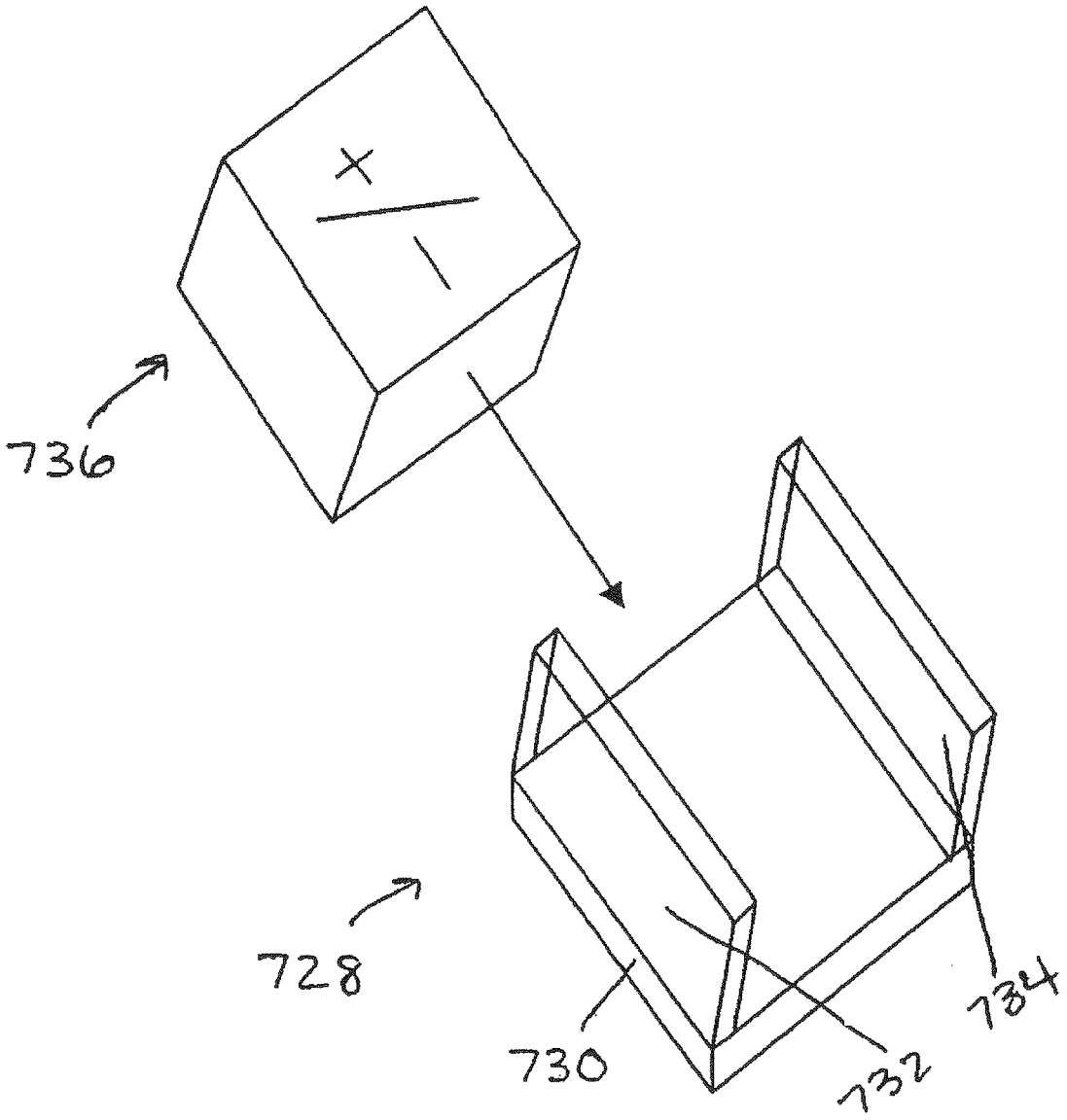
FIG. 7 shows a magnet holding device to allow a user to selectively choose between the repulsive configuration or the attractive configuration.

FIG. 7 shows a magnet holder 728 that allows magnetic door stopper 100 to switch selectively between repulsive configuration 124 and attractive configuration 226. Magnet holder 728 has a bottom 730 which can be mounted onto a door, baseboard, or wall with any appropriate holding mechanism or fastener such as a nail or screw. Two opposing sidewalls 732 and 734 project from bottom 730 of magnet holder 728. When mounting magnet holder 728, opposing sidewalls 732 and 734 should be parallel to the ground or floor. Inserted magnet 736 can be inserted into the magnet holder 728 and may be either first magnet 102 or second magnet 112. If the user wants repulsive configuration 124, inserted magnet 736 should be positioned so that the like poles of magnets 102,112 are adjacent to one another and thus repel one another. Alternatively, if the user wants attractive configuration 226, inserted magnet 736 should be positioned so that the opposite poles of magnets 102,112 are adjacent to one another and thus attract one another. The user can selectively switch between the repulsive and attractive configurations by simply removing inserted magnet 736, flipping or rotating it 180 degrees with respect to the poles, and then re-inserting magnet 736 into magnet holder 728.

Figure 8:
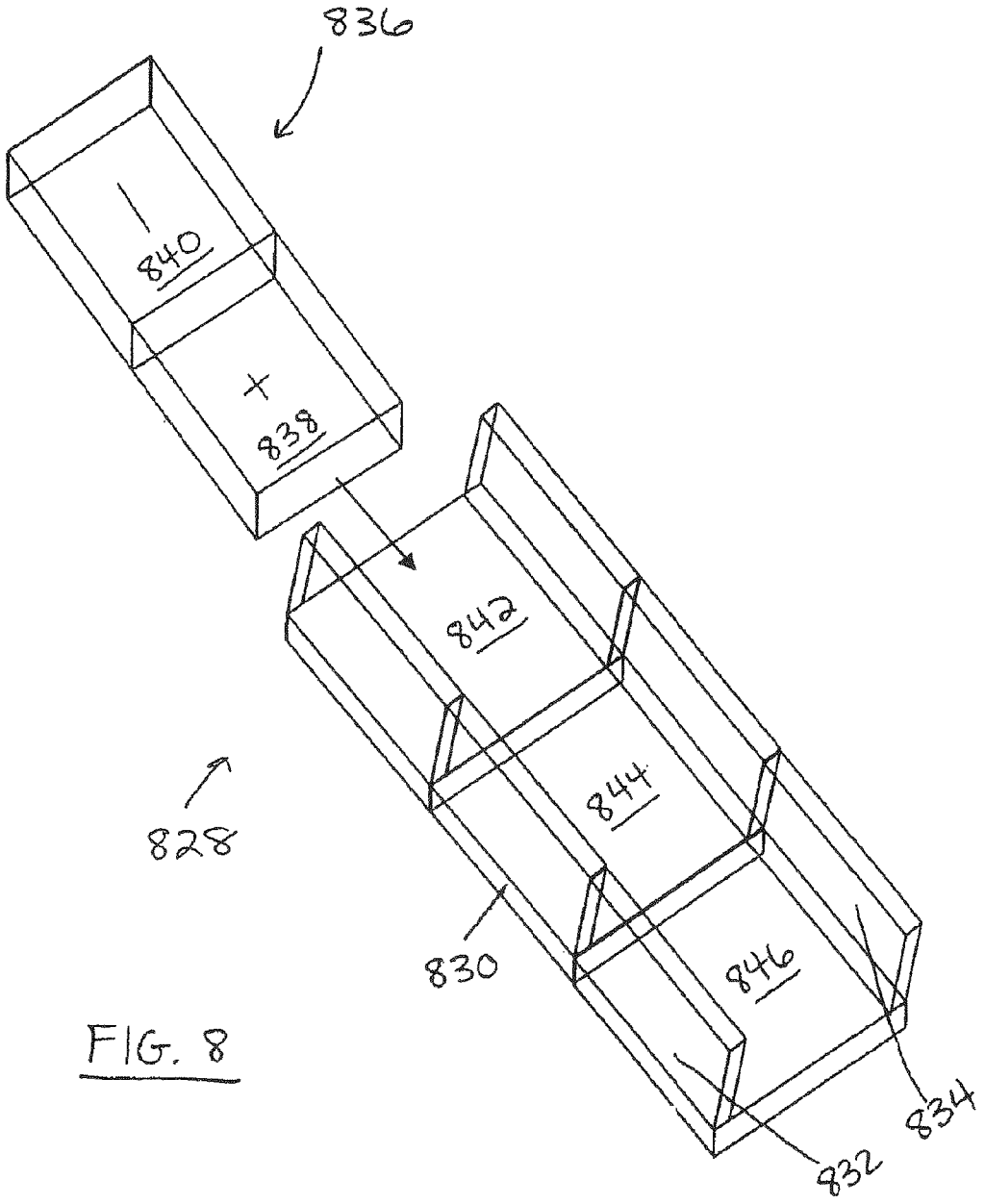
FIG. 8 is an alternate embodiment of the magnet holding device shown in FIG. 7.

FIG. 8 shows an alternate embodiment of magnet holder 728, which can also be mounted on a door, baseboard, wall or other structure. In FIG. 8, magnet holder 828 is elongated and has bottom 830 and opposing sidewalls 832 and 834. Inserted magnet 836 can be inserted into the magnet holder 828 and may be either first magnet 102 or second magnet 112. Inserted magnet 836 has two portions, "positive" portion 838 and "negative" portion 840. Elongated magnet holder 828 has three portions, left portion 842, mid-portion 844 and right portion 846. The opposing magnet of magnet door stop will be lined up so that mid-portion 844 is adjacent to the magnet opposing inserted magnet 836. For example, if magnet holder 828 is mounted on a baseboard, the mid-portion 844 will be adjacent to magnet 112 on door 110.

If the user wants repulsive configuration 124, inserted magnet 836 should be positioned so that the like poles of the magnets are adjacent to one another and thus repel one another. For example, if magnet 112 on door 110 is mounted such that the "positive" end 114 is exposed, inserted magnet 836 should be aligned so that "positive" portion 838 is located over mid-portion 844 of magnet holder 828. Alternatively, if the user wants attractive configuration 226, inserted magnet 836 should be positioned so that the opposite poles of the magnets are adjacent to one another and thus attract one another. For example, if magnet 112 on door 110 is mounted such that the "positive" end 114 is exposed, inserted magnet 836 should be aligned so that "negative" portion 840 is located over mid-portion 844 of magnet holder 828. The user can switch between the repulsive and attractive configurations by simply shifting inserted magnet 836 so that the desired portion, either "positive" portion 838 or "negative" portion 840 is located over mid-portion 844 of magnet holder 828.

Figure 9:
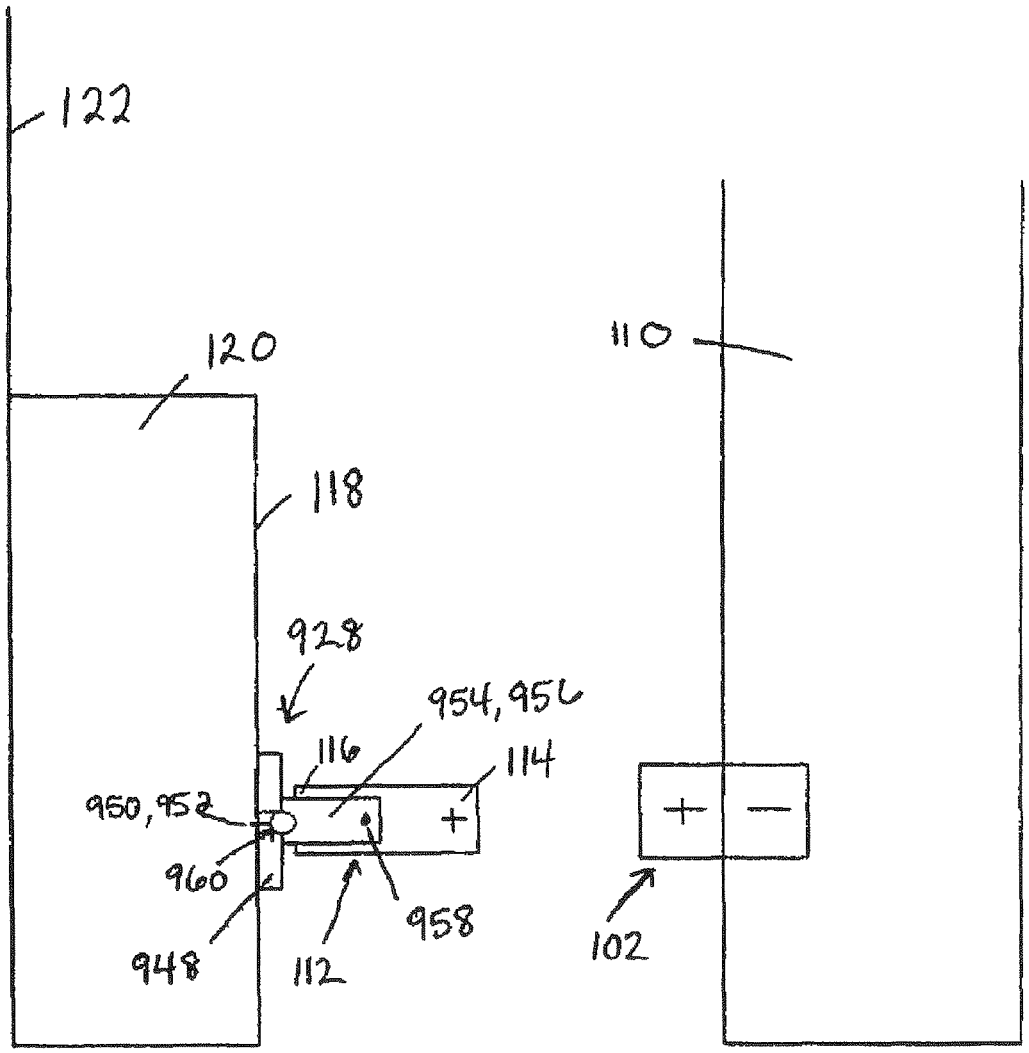
FIG. 9 is an alternate embodiment of the magnet holding device to allow a user to selectively choose between the repulsive configuration or the attractive configuration.
Figure 10:
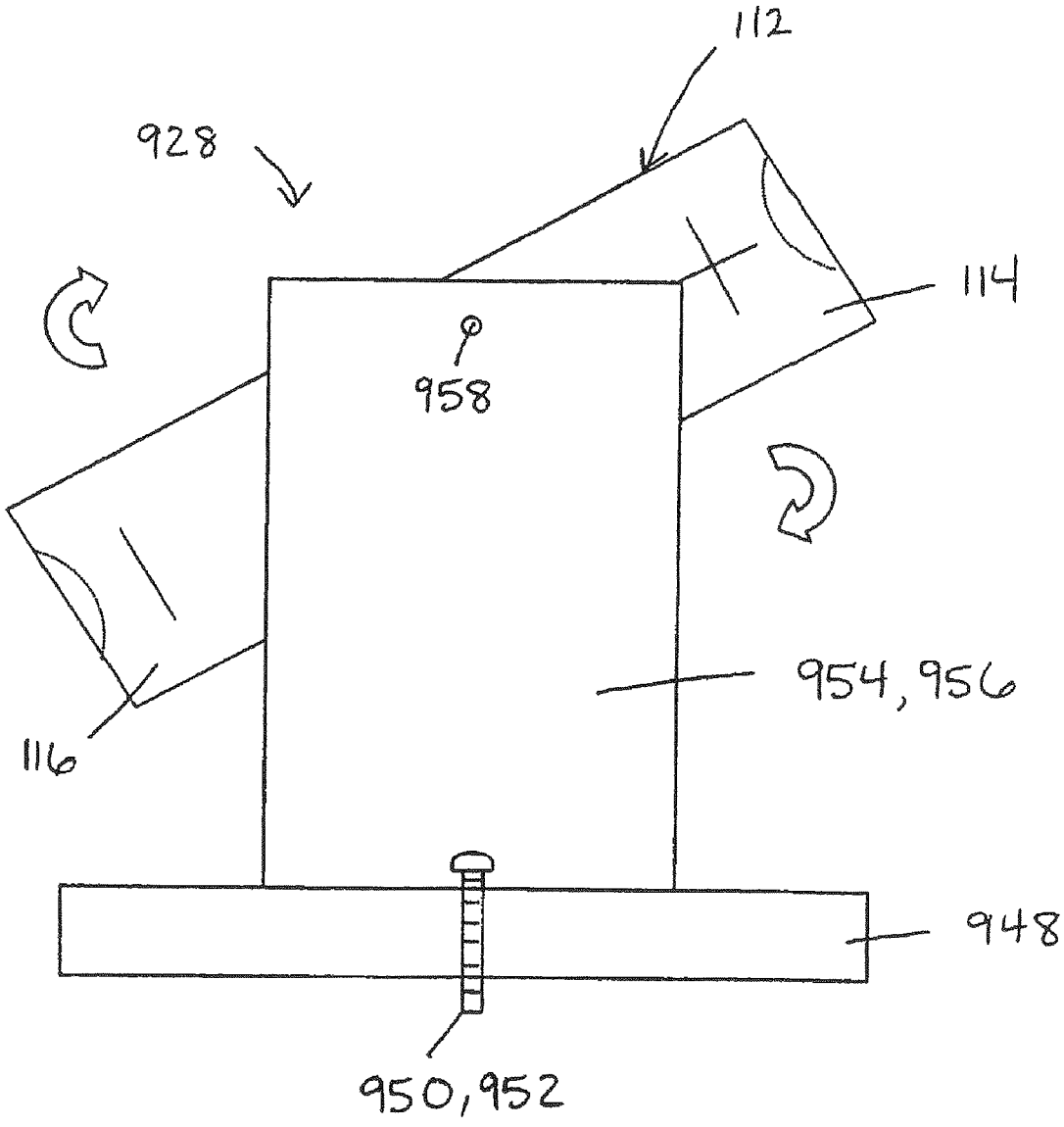
FIG. 10 is a side view of the magnet holding device shown in FIG. 9.
Figure 11:
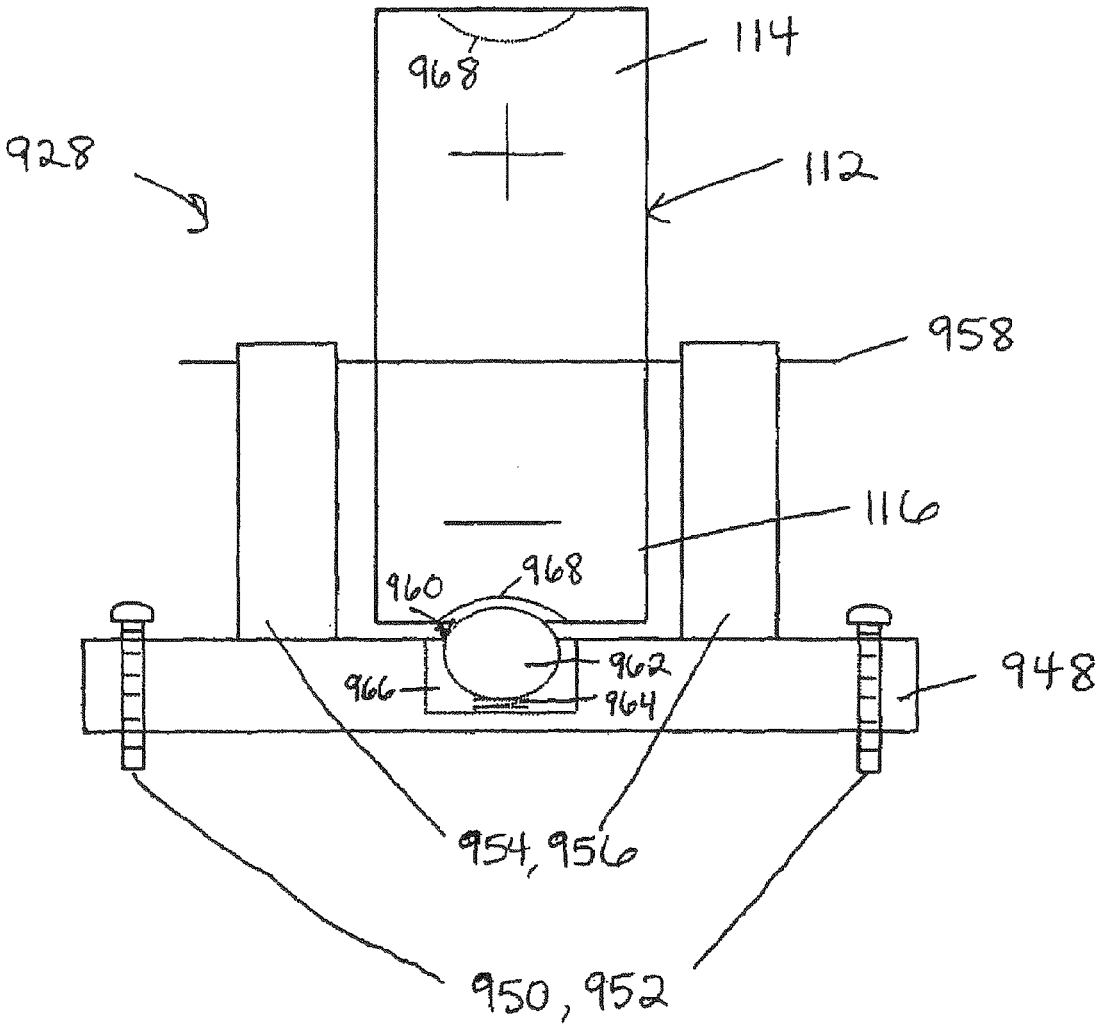
FIG. 11 is a top view of the magnet holding device shown in FIG. 9.
Figure 12:
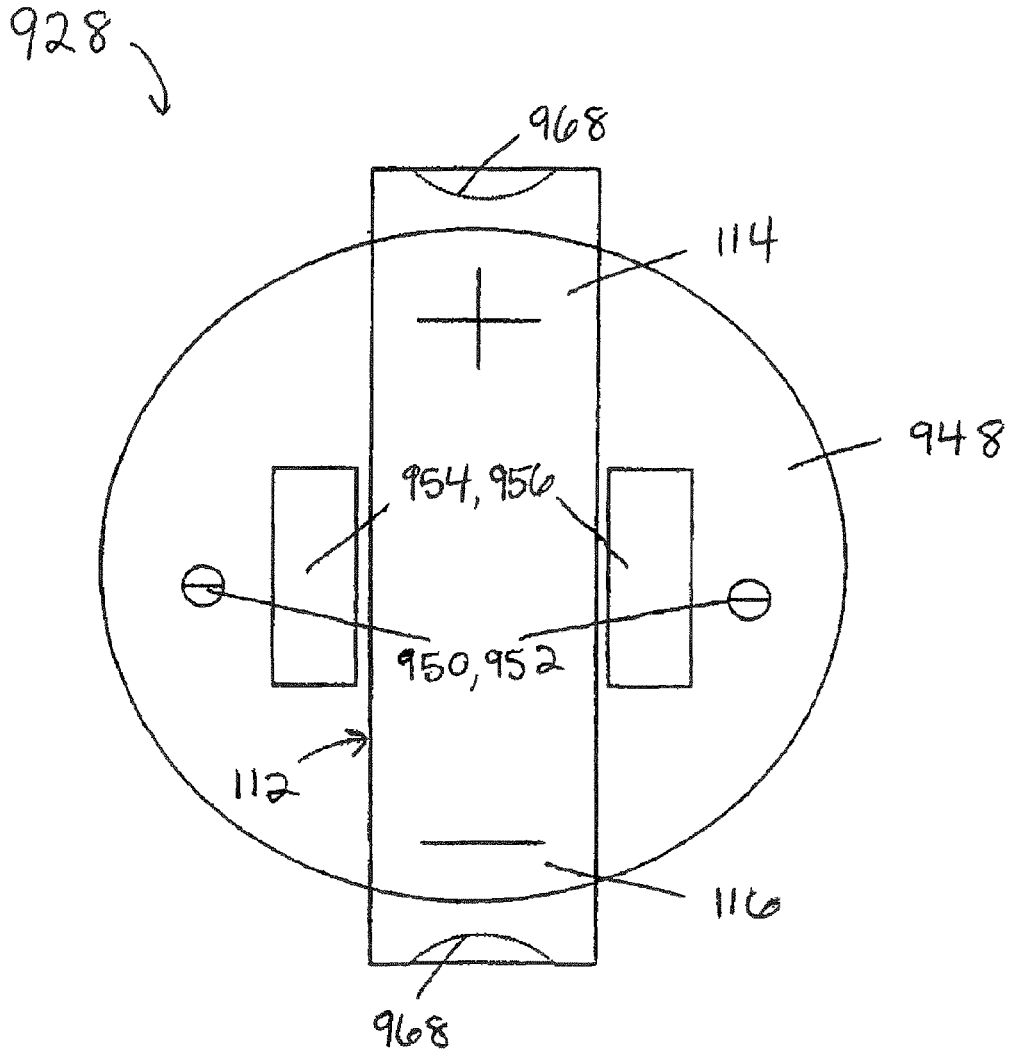
FIG. 12 is a front view of the magnet holding device shown in FIG. 9.

FIGS. 9-14 show an alternate magnet holder 928 to allow a user to selectively choose between a repulsive configuration or an attractive configuration. FIG. 9 shows first magnet 102 mounted onto door 110. Magnet holder 928 is mounted onto wall 122 or baseboard 120, and second magnet 112 is mounted therein. Magnet holder 928 includes a plate 948 which is mounted onto outside surface 118 of baseboard 120 with screws 950 and 952. Two opposing sidewalls 954 and 956 extend from plate 948 and are spaced apart enough in order to allow second magnet 112 to be placed in between. Rod 958 is placed through sidewalls 954 and 956. Second magnet 112 will contain a hole (not shown) through it. Second magnet 112 will be placed between sidewalls 954 and 956 with rod 958 extending through the hole of second magnet 112. As shown in FIG. 10, second magnet 112 will freely rotate on rod 958 to enable user to select either positive end 114 or negative end 116 of second magnet 112 to face first magnet 102 mounted on door 110.

Magnet holder 928 also includes a latch mechanism 960 which permits easy rotation of second magnet 112, but also holds magnet 112 in place when user selects repulsive or attractive configuration of magnetic door stop. Shown in FIGS. 9-14 is one possible latch mechanism comprising of a spring-loaded ball 962. Spring-loaded ball 962 is attached to a spring 964, which is located within channel 966 of plate 948. Spring 964 attached to the bottom of channel 966. Channel 966 is located within plate 948 and is of substantial size for spring loaded ball 962 to fit therein. Spring-loaded ball 962 snaps into depression 968 on the end of second magnet 112 to hold second magnet 112 in place. Depression 962 will be located on both positive end 114 of second magnet 112 and negative end 116 of second magnet 112 to enable user to select between repulsive or attractive configuration of magnetic door stop.

Figure 13:
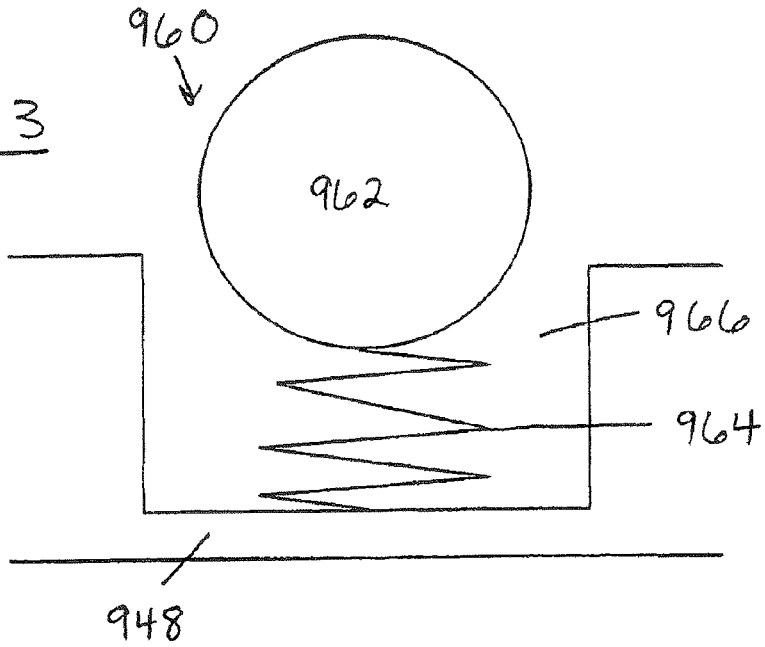
FIG. 13 is a cross-sectional view of the latching mechanism of the magnet holding device shown in FIG. 9 in its normal resting position.
Figure 14:
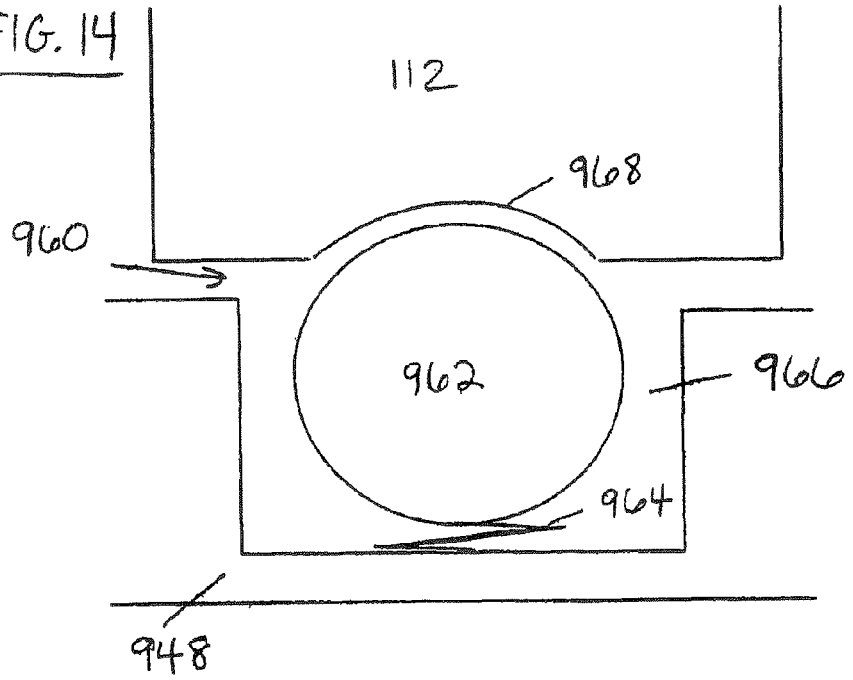
FIG. 14 is a cross-sectional view of the latching mechanism of the magnet holding device shown in FIG. 9 in its compressed position.

FIG. 13 shows latch mechanism 960 is its normal position, with spring 964 at rest. In its normal position, at least a portion of spring loaded ball 962 is located within channel 966 of plate 948. FIG. 14 shows latch mechanism 960 in its compressed position, with spring 964 compressed when spring loaded ball 962 snaps into depression 968 of second magnet 112. In its compressed position, spring loaded ball is pushed further down into channel 964 of plate 948. While magnet holder 928 is shown in the figures as being mounted on a baseboard or wall, it should be realized that magnet holder 928 could also be mounted on an exterior surface of a door.

First magnet 102 and second magnet 112 may be any appropriate magnetic material, including permanent magnets or electromagnets, and may vary in size. If magnetic door stop 100 is constructed with electromagnets, a user may select repulsive configuration 124 or attractive configuration 226 using a switch (not shown) that allows electric current to flow and consequently produces a magnetic field. In addition, magnetic door stop 100 may also be constructed by using a door of at least partially magnetic material instead of mounting first magnet 102 on door 110. With a door of at least partially magnetic material, second magnet 112 may be oriented in an attractive or repulsive configuration relative to the magnetic door.

Figure 15:
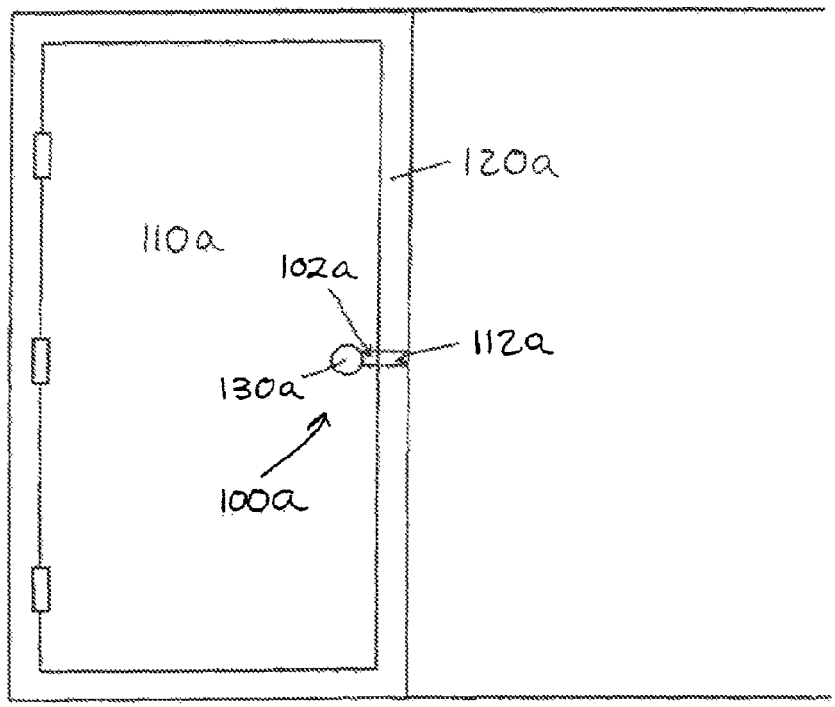
FIG. 15 shows an alternate embodiment magnetic door latch mounted in a door and a doorframe.
Figure 16:
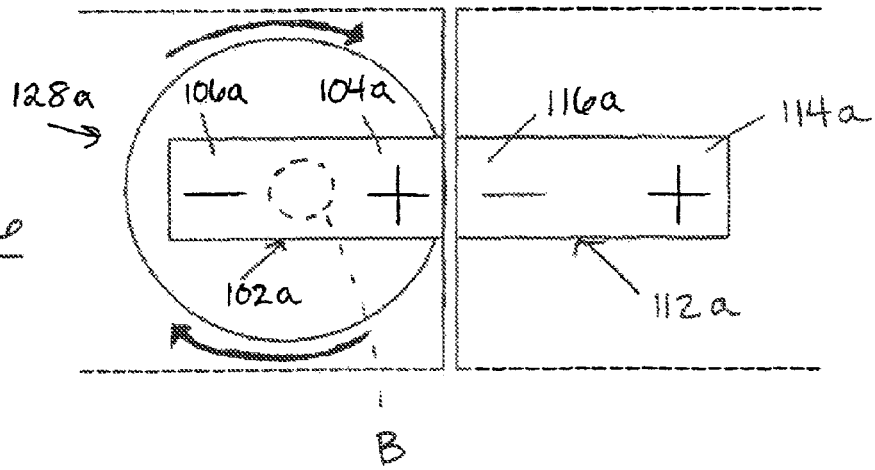
FIG. 16 shows an enlarged view of magnetic door latch in FIG. 15.
Figure 18:
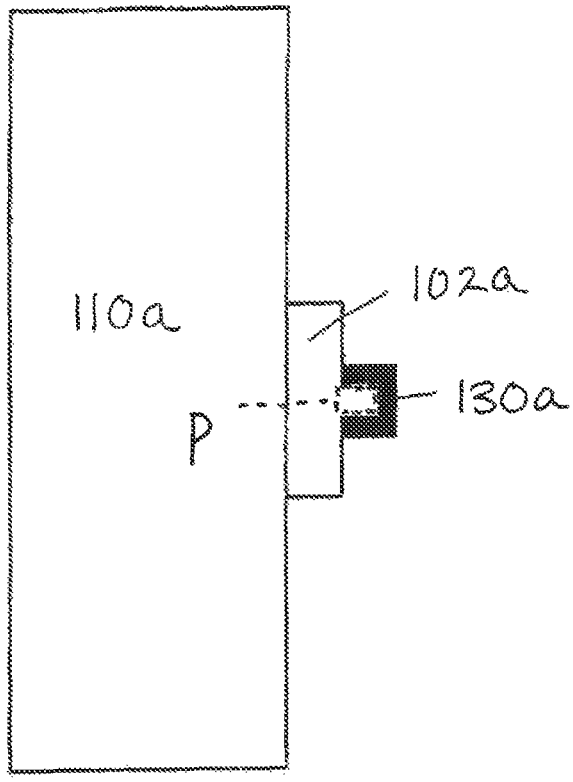
FIG. 18 is a side view of the knob mounted flush onto a door.

FIGS. 15-18 show alternate embodiment of magnetic door stop 100. Referring to FIGS. 15-16, magnetic door latch **100*a* is shown. A first magnet 102*a* having a "positive" end 104*a* and a "negative" end 106*a* is mounted flush along an exterior edge and within the thickness of door 110*a*. A second magnet 112*a* having a "positive" end 114*a* and a "negative" end 116*a* is mounted flush along an exterior edge and within the thickness of doorframe 120*a***.

First magnet **102*a* and second magnet 112*a* may be in a repulsive configuration or a attractive configuration. Repulsive configuration is accomplished when the like poles of first and second magnets are adjacent to one another and thus repel one another, i.e. "positive" end 104*a* of first magnet 102*a* will repel "positive" end 114*a* of second magnet 112*a* and "negative" end 106*a* of first magnet 102*a* will repel "negative" end 116*a* of second magnet 112*a*. Attractive configuration is accomplished when the opposite poles of first magnet 102*a* and second magnet 112*a* are adjacent to one another and thus attract one another, i.e. "positive" end 104*a* of first magnet 102*a* will attract "negative" end 116*a* of second magnet 112*a* and "negative" end 106*a* of first magnet 102*a* will attract "positive" end 114*a* of second magnet 112*a*. Attractive configuration results in door 110*a* being held in a closed position with doorframe 120*a***.

FIGS. 15-16 show a knob assembly **128*a* that allows magnetic door latch 100*a* to switch or rotate from an attractive configuration to a non-attractive or repulsive configuration. Knob assembly 128*a* contains knob 130*a*, which is attached to first magnet 102*a* by a post P positioned perpendicular to a vertical plane in which first magnet 102*a* and second magnet 112*a* commonly lie (FIGS. 17 and 18. Knob assembly 128*a* also contains a suitable bearing or bushing B to permit easy rotation of first magnet 102*a*(FIGS. 16). The suitable bearing or bushing B also contains stopping means to align first magnet 102*a* with second magnet 112*a* of doorframe 120*a*. Knob 130*a* is rotated by user, which consequently rotates first magnet 102*a* with respect to its poles to permit switch from an attractive configuration to a non-attractive or repulsive configuration. When switched to repulsive configuration, the magnets hinder the door's movement to the closed position, thus preventing or minimizing slamming. In addition, repulsive configuration may assist the user in opening door 110*a* if first and second magnets 102*a* and 112*a* are of substantial size. The size of first and second magnets 102*a* and 112*a* may vary depending on the needs of the user, i.e., a domestic user in a household doorway may only require a small magnetic latch 100***a* while a commercial user with a heavier door may require a larger magnetic latch 100*a*.

Figure 17:
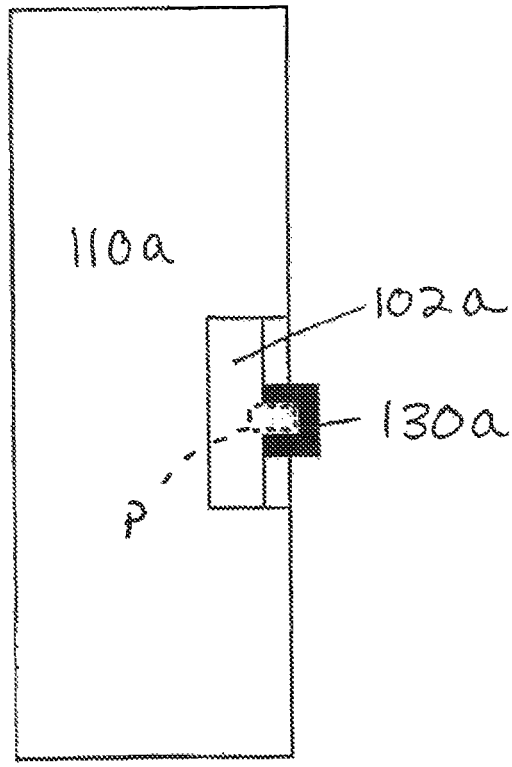
FIG. 17 is a side view of the knob mounted recessed within a door.

As shown in FIG. 17, knob 130*a* may be mounted recessed into door 110*a*. Alternatively, as in FIG. 18, knob 130*a* may be mounted flush onto exterior surface of door 110*a*.

Alternately, second magnet 112*a* may be mounted within doorframe 120*a* such that the user may selectively switch second magnet 112*a* to be in a repulsive configuration with first magnet 102*a* or an attractive configuration with first magnet 102*a*. Second magnet 112*a* may be mounted in a channel of doorframe 120*a* such that user may simply pull second magnet 112*a* out of the channel, flip it around to the desired "positive" end 114*a* or "negative" end 116*a*, and insert back in the channel.

First magnet 102*a* and second magnet 112*a* may be any appropriate magnetic material, including permanent magnets or electromagnets, and may vary in size. If magnetic door latch 100*a* is constructed with electromagnets, a user may select repulsive configuration or attractive configuration using a switch (not shown) that allows electric current to flow and consequently produces a magnetic field.

It is envisioned that the magnet holder of the door stop of the present invention may be mounted on either the door or a structure opposing the door, and that the assembly for rotating one of the magnets of the door latch of the present invention may be mounted on either the door or a structure opposing the door.

While this invention has been particularly shown and described with reference to preferred embodiments thereof, it will be understood by those skilled in the art that various changes in form and details may be made therein without departing from the spirit and scope of the invention.

What is claimed is:

1. A magnetic latch for releasably securing a pair of relatively movable components one to the other, and operable between a secured condition and a released condition, comprising:

a first magnet housed in a rotatable mounting, the first magnet having a longitudinal axis extending between a first end having a first polarity and a second end located opposite the first end and having a second polarity, a second magnet housed in a second mounting, the second magnet having a second longitudinal axis extending between a first end having a first polarity and a second end located opposite the first end and having a second polarity, the longitudinal axis of the second magnet being co-axial with the longitudinal axis of the first magnet, such that the first end of the first magnet having a first polarity is in a facing relationship with the end of the second magnet having a polarity attractive to the first polarity of the first end of the first magnet to secure the pair of relatively movable components in the secured position, wherein to release the pair of relatively movable components one from the other, the first end of the first magnet housed in the rotatable mounting is rotated about an axis perpendicular to the longitudinal axis of the first magnet to bring the first end of the first magnet out of attractive condition with the end of the second magnet; and wherein, in operation, the second magnet does not move within the second mounting in which it is housed.

2. The magnetic latch of claim 1 further comprising a knob assembly attached to the rotatable mounting in which the first magnet is housed.

3. The magnetic latch of claim 2, wherein the knob assembly is attached to the rotatable mounting by a post.

4. The magnetic latch of claim 3, wherein the post is positioned perpendicular to the longitudinal axis of the first magnet.

5. The magnetic latch of claim 4, wherein the post is coaxial with the axis perpendicular to the longitudinal axis of the first magnet.

6. The magnetic latch of claim 2, wherein the knob assembly comprises a bushing.

7. A magnetic latch for releasably securing a pair of relatively movable components one to the other, and operable between a secured condition and a released condition, comprising:

a first magnet housed in a rotatable mounting, the first magnet having a first pole with a first polarity and a second pole located opposite the first pole and having a second polarity opposite the first polarity;

a second magnet housed in a second mounting, tie second magnet having a first pole with a first polarity and a second pole located opposite the first pole and having a second polarity opposite the first polarity;

wherein when the pair of relatively movable components are in the secured condition, the first and second poles of the first magnet and the first and second poles of the second magnet are all aligned in a common axis, and when the pair of relatively movable components are in the released condition, the first and second poles of the first magnet are rotated about an axis perpendicular to the common axis out of alignment with the first and second poles of the second magnet; and wherein, in operations the second magnet does rot move within the second mounting, in which it is housed.

8. The magnetic latch of claim 7 further comprising a knob assembly having a bushing attached to the rotatable mounting in which the first magnet is housed.

9. The magnetic latch of claim 8, wherein the knob assembly is attached to the rotatable mounting by a post.

10. The magnetic latch of claim 9, wherein the knob assembly is mounted perpendicular to the common axis.

11. The magnetic latch of claim 8, wherein the knob assembly comprises a bushing.

12. A magnetic latch for a pair of relatively movable components one to the other, comprising:

a first magnet housed in a rotatable mounting, the first magnet having a first pole with a first polarity and a second pole located opposite the first pole and having a second polarity opposite the first polarity, and a second magnet housed in a non-rotatable mounting, the second magnet having a first pole with a first polarity and a second pole located opposite the first pole and having a second polarity opposite the first polarity, the first rotatable mounting and the non-rotatable mounting positioned within a common plane, such that the first and second poles of the first magnet housed within the rotatable mounting are rotatable within the common plane in which the rotatable mounting and non-rotatable mounting are positioned;

wherein, in operation, the second magnet does not move within the non-rotatable mounting in which it is housed.

13. The magnetic latch of claim 12 further comprising a knob assembly attached to the rotatable mounting in which the first magnet is housed.

14. The magnetic latch of claim 13, wherein the knob assembly is attached to the rotatable mounting by a post.

15. The magnetic latch of claim 12, wherein the knob assembly comprises a bushing.

* * * * *